US006314885B1

(12) United States Patent
Tobin et al.

(10) Patent No.: US 6,314,885 B1
(45) Date of Patent: Nov. 13, 2001

(54) IMPOSITION PROOFING

(75) Inventors: Jeff Tobin, Nashua, NH (US); Robert Bullock, Acton, MA (US)

(73) Assignee: Iris Graphics, Inc., Billerica, MA (US)

( * ) Notice: Subject to any disclaimer, the term of this patent is extended or adjusted under 35 U.S.C. 154(b) by 0 days.

(21) Appl. No.: 09/366,456

(22) Filed: Aug. 3, 1999

Related U.S. Application Data

(63) Continuation-in-part of application No. 09/262,950, filed on Mar. 4, 1999.

(51) Int. Cl.[7] ..... B41F 21/12
(52) U.S. Cl. ..... 101/485; 428/192; 101/483
(58) Field of Search ..... 428/192; 283/74; 206/215, 449, 454, 455; 347/197, 106, 101, 104, 105; 226/6; 402/79; 101/485, 483

(56) References Cited

U.S. PATENT DOCUMENTS

| | | | | |
|---|---|---|---|---|
| 2,118,828 | | 5/1938 | Sherman | 282/12 |
| 2,353,902 | * | 7/1944 | Johnson | 271/168 |
| 3,360,258 | * | 12/1967 | Nix | 462/55 |
| 3,637,203 | | 1/1972 | French | 271/53 |
| 4,084,911 | | 4/1978 | DeWitt | 402/15 |
| 4,260,248 | * | 4/1981 | Murata et al. | 355/60 |
| 4,402,585 | | 9/1983 | Gardlund | 353/120 |
| 4,447,973 | | 5/1984 | Wihlke | 40/776 |
| 4,561,646 | * | 12/1985 | Ellis et al. | 271/236 |
| 4,629,070 | | 12/1986 | Roberg | 206/455 |
| 4,787,766 | | 11/1988 | Lorsch | 402/79 |
| 4,925,720 | | 5/1990 | Hansen | 428/77 |
| 4,972,952 | | 11/1990 | Reiseneder | 206/456 |
| 4,984,924 | | 1/1991 | Erlich | 402/4 |
| 5,000,319 | | 3/1991 | Mermelstein | 206/455 |
| 5,073,059 | | 12/1991 | Josephson | 402/80 R |
| 5,263,705 | | 11/1993 | Schmaling | 271/246 |
| 5,417,509 | | 5/1995 | Schwartz | 402/79 |
| 5,421,665 | | 6/1995 | Strassberg | 402/79 |
| 5,464,255 | | 11/1995 | Schildmeyer | 283/116 |
| 5,566,933 | | 10/1996 | Salancy | 271/273 |
| 5,599,128 | * | 2/1997 | Steiner | 402/79 |
| 5,632,566 | * | 5/1997 | Korzilius et al. | 402/79 |
| 5,722,694 | | 3/1998 | Baldursson | 283/116 |
| 5,810,494 | | 9/1998 | Menard et al. | 400/634 |
| 5,924,227 | * | 7/1999 | Sommers | 40/360 |
| 5,945,179 | * | 8/1999 | Gautreneau | 428/14 |
| 5,954,445 | * | 9/1999 | Deutschmann et al. | 402/79 |
| 6,016,752 | | 1/2000 | Harari | 101/486 |
| 6,093,447 | | 7/2000 | Johnson et al. | 427/146 |
| 6,099,189 | * | 8/2000 | Owen et al. | 402/79 |
| 6,140,406 | * | 10/2000 | Schliesman et al. | 524/93 |
| 6,169,557 | | 1/2001 | Suzuki et al. | 347/104 |

FOREIGN PATENT DOCUMENTS 11-91253 * 4/1999 (JP) .

OTHER PUBLICATIONS

Stephen F. Pond, Ph.D., "Inkjet Technology," Torrey Pines Research, pp. 211–225, 2000.

Staples, Late Winter 2001 Catalog, pp. 5–11, 2001.

* cited by examiner

*Primary Examiner*—Daniel J. Colilla
(74) *Attorney, Agent, or Firm*—Kristofer E. Elbing

(57) ABSTRACT

A deposited ink drop imposition proofing print sheet that includes two deposited ink drop printable faces each having a periphery defined by an ordered series of first, second, third, and fourth edges. These two faces have properties resulting from a deposited ink drop print-enhancing treatment. The sheet defines two first registration openings. The first is located closer to the first sheet edge than to the third sheet edge and closer to the second sheet edge than to the fourth sheet edge. The second is located closer to the first sheet edge than to the third sheet edge and closer to the fourth sheet edge than to the second sheet edge. In one embodiment, an inner edge of the first registration opening is nominally separated from an inner edge of the second registration opening by at least 36 inches.

44 Claims, 6 Drawing Sheets

IMPOSITION PROOFING

This application is a continuation-in-part of United States Patent application entitled "Impositon Proofing," identified by Ser. No. 09/262,950, and filed on Mar. 4, 1999.

FIELD OF THE INVENTION

This invention relates to imposition proofing and printing stock for imposition proofing.

BACKGROUND OF THE INVENTION

High volume printing of books, brochures, and other multi-page documents typically involves imposition. Imposition is the process of laying out the pages of a document such that they are in numerical order after a larger printed sheet, known as a signature, has been folded into multiples of four pages that make up a section of the document. Before printing the signatures with high-volume, double-sided printers, it is common practice to print a set of proofs using an imposition proofing printer.

Imposition proofing printers are typically relatively large, single-sided, tractor-fed, ink-jet printers. These printers first print one side of a signature on a large sheet of tractor-fed paper. An operator then turns the paper over and threads it back onto the printer's tractor feed mechanism so that the printer can print the other side.

SUMMARY OF THE INVENTION

In one general aspect, the invention features a deposited ink drop imposition proofing print sheet that includes a first rectangular deposited ink drop printable face having a periphery defined by an ordered series of first, second, third, and fourth edges of the imposition proofing print sheet, the first face having properties resulting from a deposited ink drop print-enhancing treatment and a second rectangular deposited ink drop printable face opposite the first face. The second face also has a periphery defined by the first, second, third, and fourth edges of the imposition proofing print sheet and has properties resulting from a deposited ink drop print-enhancing treatment. The sheet defines a first registration opening located closer to the first sheet edge than to the third sheet edge and closer to the second sheet edge than to the fourth sheet edge. The sheet also defines a second registration opening located closer to the first sheet edge than to the third sheet edge and closer to the fourth sheet edge than to the second sheet edge. An inner edge of the first registration opening is nominally separated from an inner edge of the second registration opening by at least 36 inches. The first registration opening can be nominally 0.5 inches wide and 0.25 inches deep, with the second registration opening being nominally 0.25 inches wide and 0.25 inches deep, and with an inner edge of the first registration opening being nominally separated from an inner edge of the second registration opening by 38.5 inches.

In preferred embodiments, the width of the second registration opening can be greater than the width of the first registration opening, in a direction parallel to the first edge of the imposition proofing sheet. The width of the second registration opening can exceed the width of the first registration opening by about the range of dimensional change with humidity of the sheet between the first and second registration openings in a direction parallel to the first edge of the imposition proofing sheet. The sheet can define the first registration and second registration openings as openings that begin at the first sheet edge. The first and third edges can be at least 42 inches in length, with the second and third edges being at least 30 inches in length and with the first and second registration openings being peripheral to a 42 inch×30 inch printable area of the sheet. The first and second registration openings can be rectangular, and the first and second faces can be coated with the deposited ink drop print-enhancing composition. The faces can include a deposited ink drop print-enhancing composition to achieve the properties, such as by including a coating of the deposited ink drop print-enhancing composition. An inner edge of the first registration opening can be nominally separated from an inner edge of the second registration opening by at least 36 inches. All of the inner edges of the first opening can even be separated by at least 38.5 inches from all of the inner edges of the second opening.

In another general aspect, the invention features an imposition proofing printer that includes at least one feed roller located along a printing substrate feed path and having an axis of rotation, at least one pinch roller located along the printing substrate feed path and having an axis of rotation parallel to the axis of rotation of the feed roller, and a disengagement mechanism linked to one or more of the feed roller and the friction feed drum. A first retractable registration pin has an alignment surface located along the printing substrate feed path, and a second retractable registration pin has an alignment surface located along the printing substrate feed path and being spaced from the first retractable registration pin in at least a direction parallel to the axis of rotation of the feed roller. In preferred embodiments, the imposition proofing printer can further include a mechanism linking the first and second retractable stops and the disengagement linkage. The substrate feed path can be at least 30 inches wide.

In a further general aspect, the invention features an imposition printing method that includes the steps of disengaging rollers from a print substrate feed path, deploying a pair of registration stops in the print substrate feed path, aligning a print substrate in the print substrate feed path by engaging openings in the print substrate with respective ones of the pair of stops, engaging the rollers with the print substrate, and retracting the registration stops from the print substrate feed path. In preferred embodiments, the steps of disengaging and deploying can take place in unison, with the steps of engaging and retracting deploying take place in unison. The step of aligning can align a print substrate with registration openings of different widths, and the width of a second of the registration openings can exceeds a width of a first of the registration openings by about the range of dimensional change with humidity of the printing substrate between the first and second registration openings.

In another general aspect, the invention features a method of making a deposited ink drop imposition printing sheet. This method includes providing a rectangular imposition proofing sheet including a first printable face having periphery defined by an ordered series of first, second, third, and fourth edges of the imposition proofing print sheet, and a second rectangular deposited ink drop printable face opposite the first face and also having a periphery being defined by the first, second, third, and fourth edges of the imposition proofing print sheet, and cutting registration means for receiving a pair of rectangular spaced-apart stops along the first edge of the imposition proofing sheet. An inner edge of the first registration opening is nominally separated from an inner edge of the second registration opening by at least 36 inches. The first registration opening can be nominally 0.5 inches wide and 0.25 inches deep, with the second registration opening being nominally 0.25 inches wide and 0.25 inches deep, and with an inner edge of the first registration opening being nominally separated from an inner edge of the second registration opening by 38.5 inches.

In preferred embodiments, the step of cutting can be applied to a maximum of ten sheets. The step of cutting can define a pair of registration openings of different widths. The width of a second of the registration openings can exceed a width of a first of the registration openings by about the range of dimensional change with humidity of the printing substrate between the first and second registration openings.

Embodiments according to the invention may be advantageous in that they simplify the loading of imposition sheets in an imposition proofing printer while retaining a high level of precision at different humidity levels. The shape and position of the registration openings can permit the user to quickly and reliably align a sheet in a printer's feed path, and linking of stop deployment and roller disengagement mechanisms can further simplify this operation. The alignment can therefore take place quickly and easily without requiring the operator to thread a number of holes onto a tractor feed mechanism. The shape and position of the registration openings also allows the alignment to take place independent of variations in ambient humidity. As a result, humidity-based errors can be reproducibly accounted for, and their effects minimized. Embodiments of the invention are further advantageous in that the printer and printable sheets need only employ a single pair of stops and registration openings to achieve a high degree of alignment.

DESCRIPTION OF AN ILLUSTRATIVE EMBODIMENT

Figure 1A:
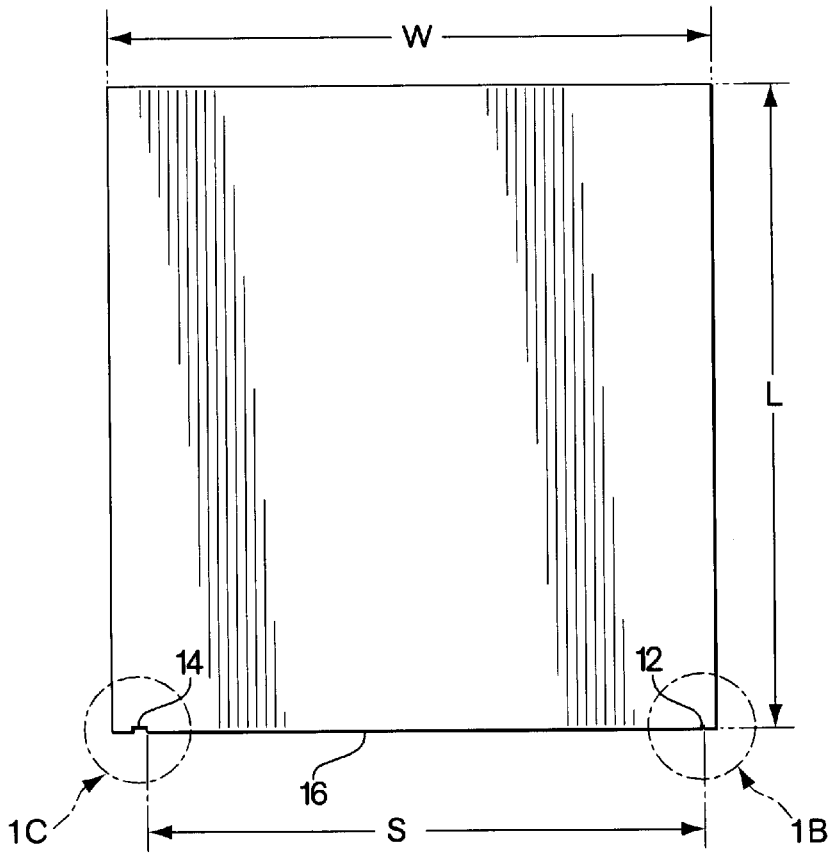
FIG. 1A is a plan view of a printable sheet according to the invention.
Figure 1B:
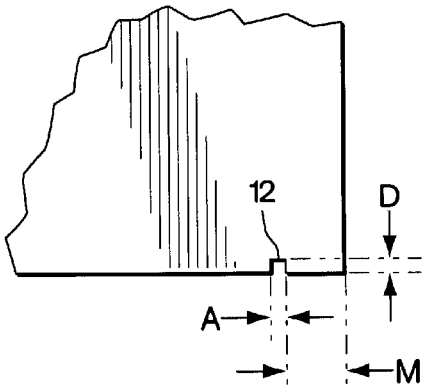
FIG. 1B is an enlarged view of a first corner portion of the printable sheet of FIG. 1A showing a first alignment opening.
Figure 1C:
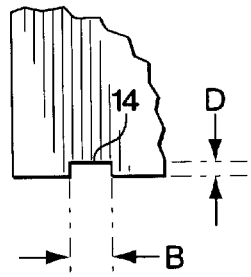
FIG. 1C is an enlarged view of a second corner portion of the printable sheet of FIG. 1A showing a second alignment opening.

Referring to FIGS. 1A–1C, a printable sheet 10 according to the invention is a four-sided rectangular sheet having a first registration opening 12 and a second registration opening 14. The sheet is made up of a printable area and a series of margin areas, which include the registration openings. In one embodiment, the sheet has a length L of 35 inches and a width W of 42 inches, with a 42×30 inch printable area. These dimensions are beneficial in that they allow proofs to be printed for a large number of imposition printing applications.

The registration openings 12, 14 are positioned to prevent rotation of the sheet 10 relative to a print head path, and are preferably located at the leading edge 16 of the sheet. They can be open-ended openings cut out of the leading edge, or they can be closed-ended holes proximate the leading edge. The separation S between the registration openings is preferably as large as possible, consistent with margins M that define the openings. This large separation helps to reduce any misalignment due to dimensional errors in the openings.

The registration openings preferably have different widths. The width A of the first opening 12 preferably matches the width of one of two identical and symmetrically disposed registration stops (see FIG. 2), while the width B of the second opening 14 is greater than the width of the stops. This difference allows the sheet to reliably interact with the stops despite differences in humidity that result in expansion and contraction of the sheet. Specifically, the width of the second opening should exceed the width of the first by at least the range of dimensional change that results from changes in humidity under normal operating conditions. Typical dimensional change numbers for paper of the general type used in imposition printing are:

50% to 20%RH −0.1% in the cross grain direction

50% to 20%RH −0.06% in the grain direction

50% to 80%RH +0.25% in the cross grain direction

50% to 80%RH +0.06% in the grain direction

In one embodiment, the first opening is 0.25 inches wide and the second is 0.75 inches wide to accommodate a +/−0.25 inch expansion specification for a normal humidity range of 20% to 80%. A 0.5 inch wide second opening is also contemplated for typical imposition applications. Both openings have a depth D of 0.25 inches.

In another embodiment, the first opening is 0.25 inches wide and the second is 0.50 inches wide to accommodate a +/−0.125 inch expansion specification for a normal humidity range of 20% to 80%. Both openings have a depth D of 0.25 inches. The separation between the inner edges of the openings is at least 36 inches and preferably 38.5 inches.

The faces of the sheet should both be printable using deposited ink drops, such as by ink-jet printing or deposit on demand printing. To this end, the faces can be coated with one or more compositions that enhance the holding of ink, improve the take up of solvent, and/or prevent excessive bleeding on either face or from face to face. The compositions can also be added to the sheet material (e.g., paper) to produce a uniform sheet with deposited ink drop printable characteristics. Anti-cockle agents can also be added to prevent cockling, a repetitive buckling effect, in areas of dense printing. Coatings that prevent solvent from reaching the paper they are applied to are particularly useful in imposition printing applications, because they prevent ink from causing the paper to expand during printing of a first side, resulting in misalignment of the print on the other side. The sheet can also include other treatments to enhance printing using deposited ink drops, such as calendaring. Sheet treatments can improve the print characteristics of a sheet surface, an inner volume within the paper, or both, with the result that the printing characteristics on the sheet surface are improved. Suitably prepared paper is available, for example, from Dupont.

Figure 2:
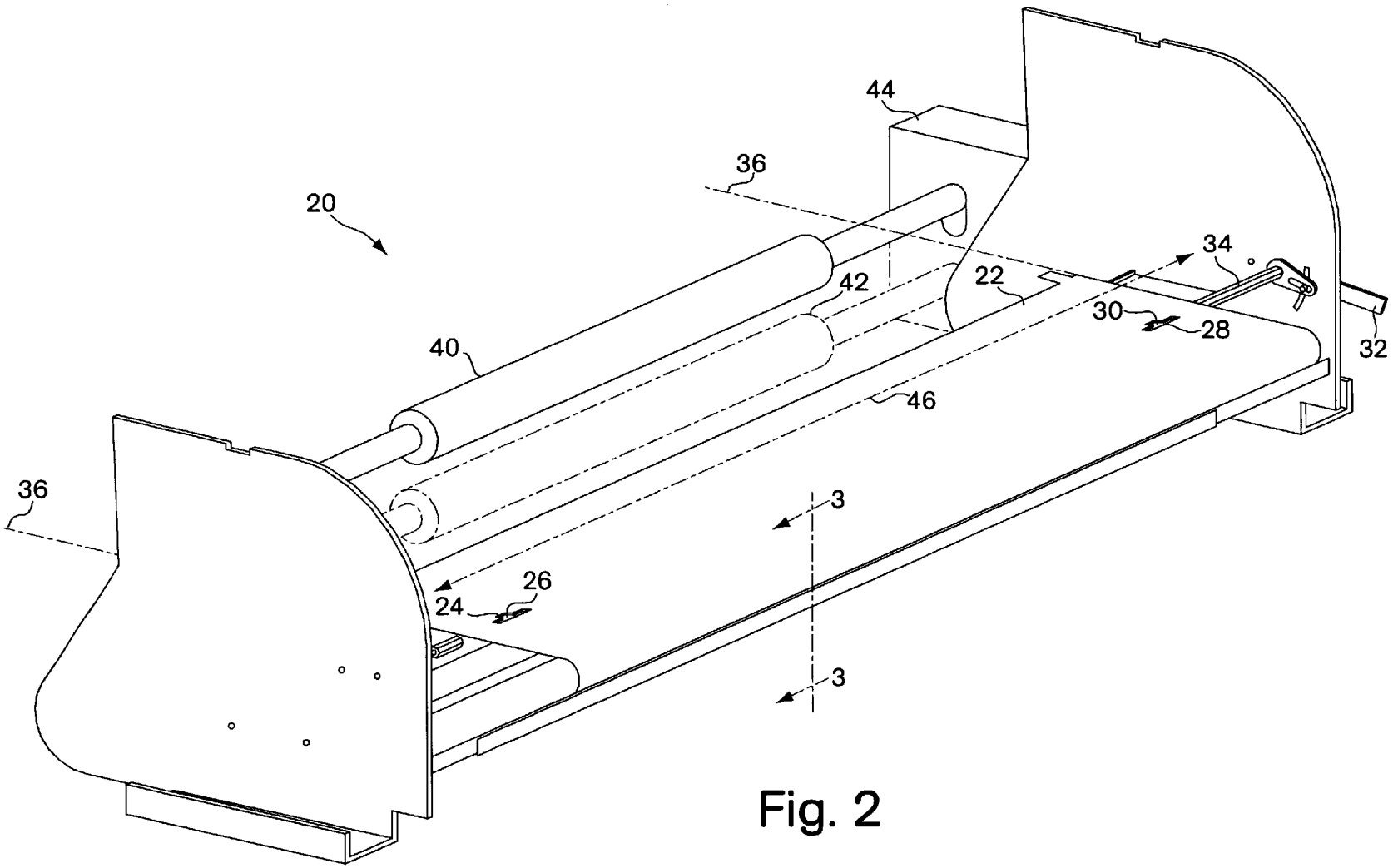
FIG. 2 is a diagrammatic isometric view of a printer feed mechanism according to the invention for printing on the sheet of FIG. 1A.

Referring to FIGS. 1A–2, a printer feed mechanism 20 includes a platen surface 22 with a first hole 24 through which a first registration stop 26 protrudes and a second hole 28 through which a second alignment stop 30 protrudes. The centers of the stops are separated by the nominal separation of the registration openings in the printable sheet at the middle of the humidity range (e.g., 50% humidity), and are slightly offset from a centerline of a feed path 36 to make up for the difference in the widths of the registration openings. A pivoting load lever 32 is connected to a hexagonal shaft 34 that runs under the platen surface. As is conventional, the platen has holes in it to allow a vacuum in a chamber beneath the platen to help hold the sheet in place over the platen.

Further along the feed path 36 of the printer there is a roller assembly that can be made up of at least one feed roller 40, at least one pinch roller 42, and a disengagement mechanism 44. A number of different types of rollers and disengagement mechanisms are suitable for use with the invention. For example, the rollers can be elastomeric rollers with a resilient, tacky surface, or they can be diamond-coated steel rollers with a fine grit surface. There can be more than one shaft for feed rollers and/or pinch rollers, and each shaft may bear more than one roller. Suitable roller mechanisms are available on printers manufactured by Hewlett-Packard, Calcomp, Mutoh, and other manufacturers. A print head path 46 for a swathing deposited ink drop print head is located between the platen 22 and the roller assembly.

Figure 3:
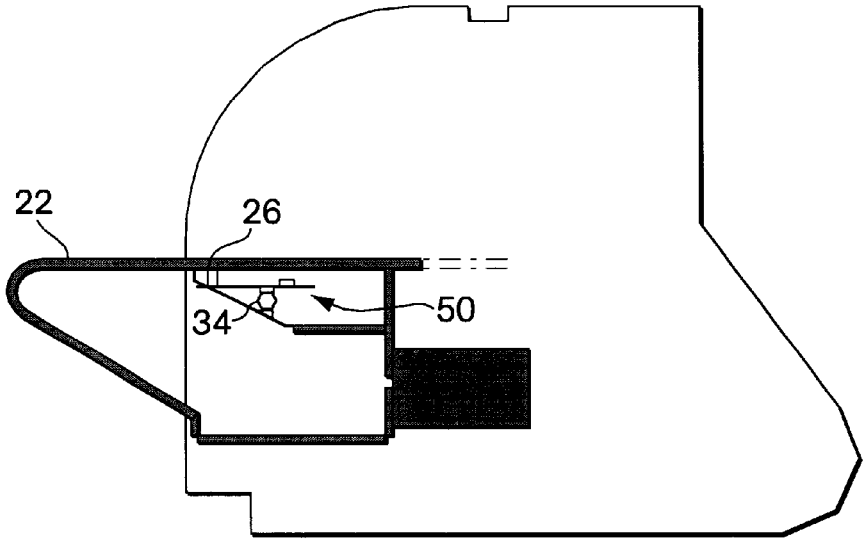
FIG. 3 is a cross section of the feed mechanism of FIG. 2 along the line labeled 3—3 in FIG. 2.

Referring to FIGS. 2–3, the first registration stop 26 is part of a first spring-loaded pivoting registration stop rocker 50. This rocker includes a bearing surface which is pressed onto the hexagonal shaft 34 by a spring, such that rotation of the shaft by the load lever 32 lifts the first registration stop up through the first hole 24. The second registration stop 30 forms part of a second spring loaded pivoting registration stop rocker, which is similarly situated with respect to the hexagonal shaft.

Figure 4:
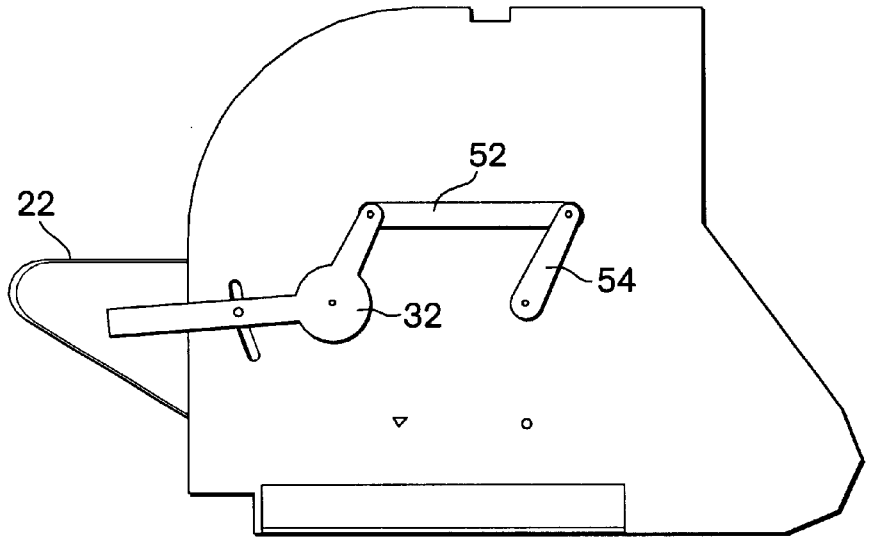
FIG. 4 is an end view of the feed mechanism of FIG. 2.
Figure 5:
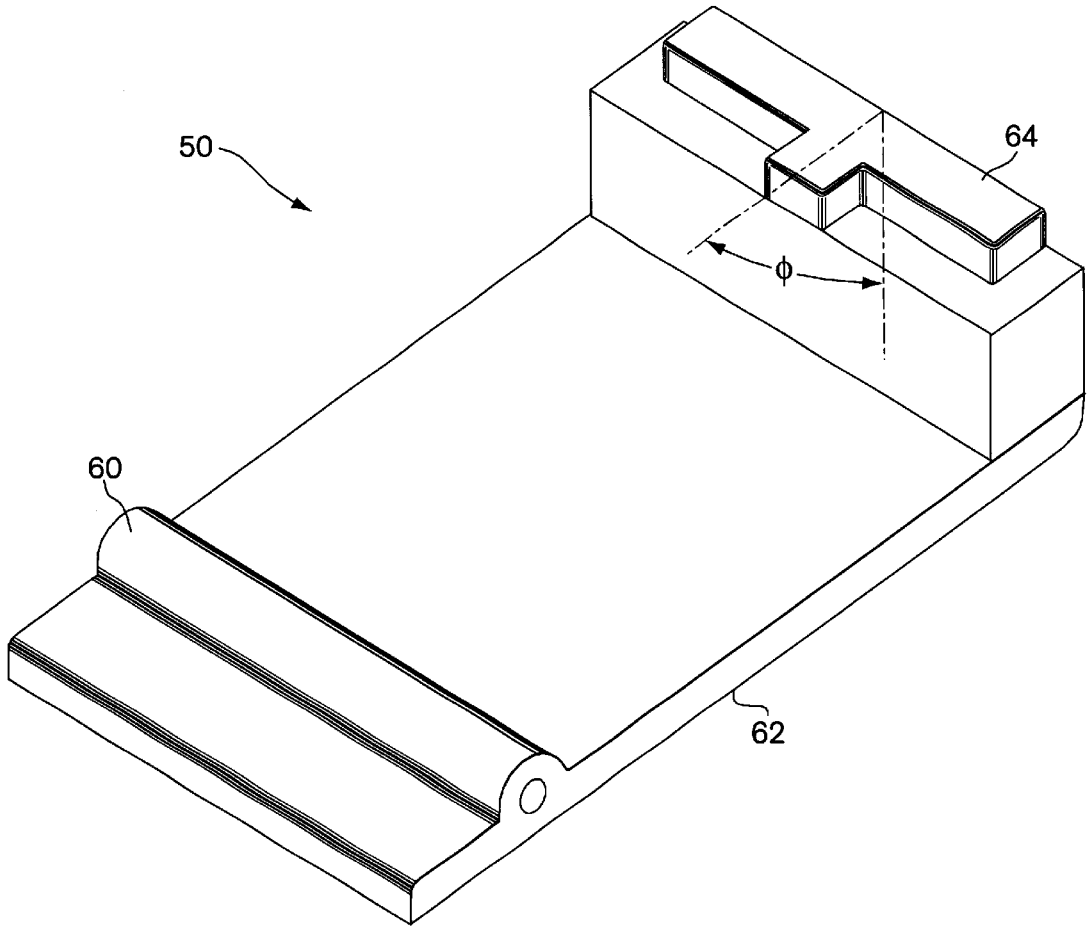
FIG. 5 is an isometric view of a first stop rocker for the printer feed mechanism of FIG. 2.
Figure 6:
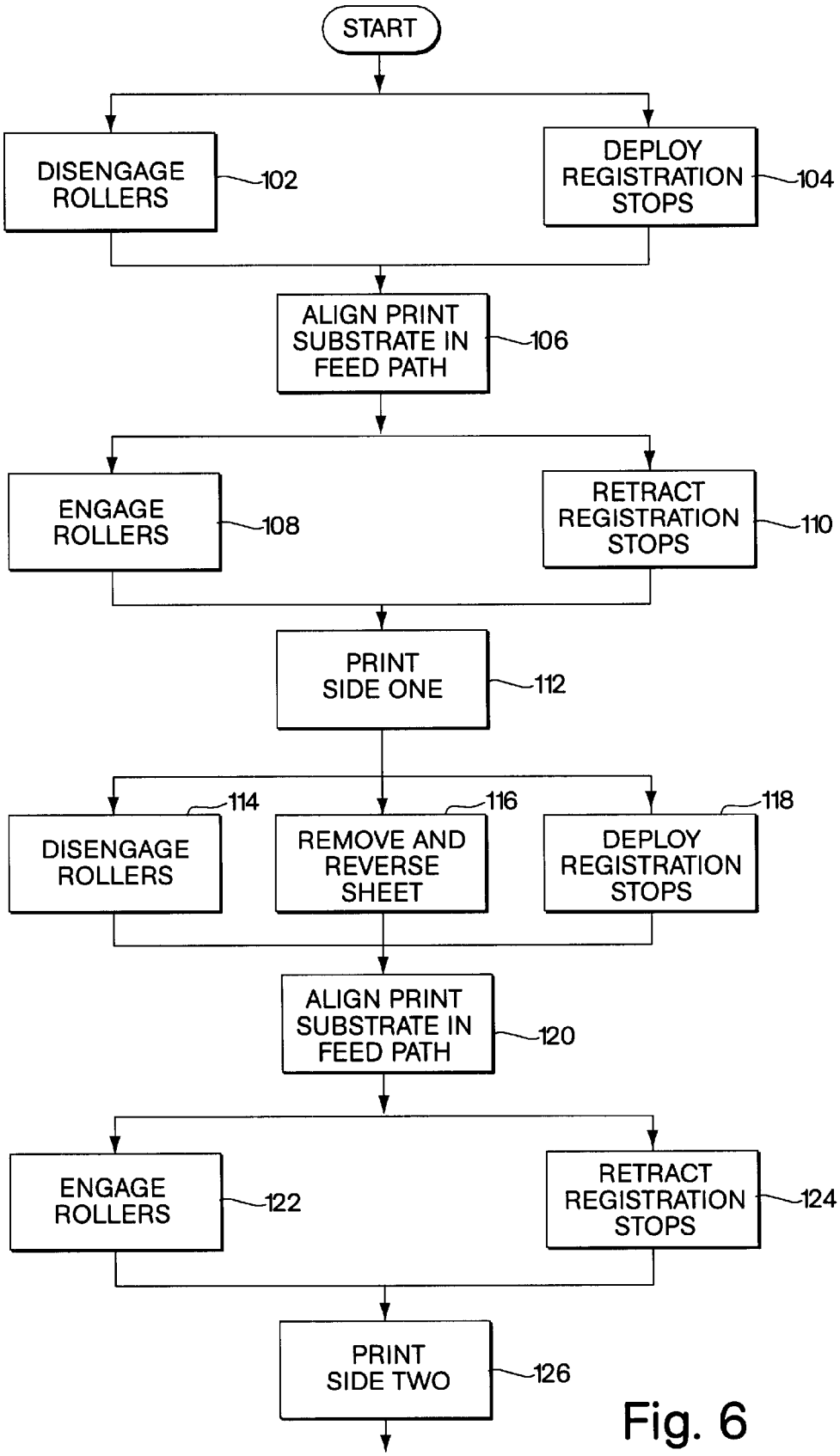
FIG. 6 is a flowchart illustrating a two-sided printing operation on the sheet of FIGS. 1A–1C using the feeding mechanism of FIG. 2.

Referring to FIG. 4, the roller disengagement mechanism 44 can be linked to the stop retraction mechanism. The link between the two mechanisms can take on a number of forms, such as linkages, belts, gears, or any other suitable mechanism. The two mechanisms can also be driven by solenoids and sequenced electronically, such as by a microprocessor.

In one embodiment, the roller disengagement mechanism includes a second hexagonal shaft that separates the rollers by a cam action, similar to the cam action that engages and disengages the stops. In this embodiment, the two hexagonal shafts are linked by a four-bar linkage made up of a portion of the handle 32, a linking member 52, and a radial member 54 attached to the second hexagonal shaft.

Referring to FIGS. 1A, 1B, 1C, and 5, the stop rocker 50 includes a pivot 60, a bearing surface 62, and a stop 64. In one embodiment, the stop is T-shaped with the trunk of the "T" facing toward the roller mechanism. This protrusion is slightly smaller than the first registration opening 12 in the printable sheet 10, so that the two engage readily. The rear stop area formed by the underside of the top of the "T" is the surface against which the portions on either side of the leading edge surrounding the registration openings of the sheet butts. It should be just wide enough to hold the paper under all rated humidity conditions. For example, where the smaller registration opening is a 0.25 inch square, all of the segments of the "T" in the registration stop can be 0.22 inches wide, with the trunk of the "T" being a 0.22 inch square and the top of the "T" being 1 to 1.25 inches long overall. The top surface of the stop slopes downward toward the roller mechanism when it is engaged (e.g., sloped by an angle Ø of about 85 degrees from vertical). This slope helps to prevent the sheet from becoming caught on the leading edge of the stop or the trailing edge of its hole as it is advanced by the rollers.

Referring to FIGS. 1–6, imposition printing on a printable sheet 10 using the printer feed mechanism 20 will now be described. Before inserting a printable sheet, the feed mechanism disengages the feed and/or pinch rollers (step 102). This can take place in response to actuation of the user of a mechanical lever or in response to an electrical signal.

The feed mechanism also deploys the registration stops 26, 30 (step 104). This operation can occur simultaneously with the disengagement of the roller mechanism (step 102), such as may take place where the mechanism is mechanically linked, or at least in unison (i.e., in a coordinated, but not necessarily simultaneous, fashion) with the disengagement of the roller mechanism, such as may take place when the two operations are sequenced by a microprocessor. The two operations can also proceed independently, in any order.

The operator then inserts the printable sheet into the feed mechanism and butts the ends of the registration openings up against the ends of the registration stops to align the sheet in the feed path (step 106). The feed mechanism then engages the rollers (step 108) and retracts the stops (step 110). These two operations can take place simultaneously, in unison, or independently, although it appears to be preferable to engage the vacuum hold through the platen before engaging the rollers and to retract the stops after engaging the rollers. With the rollers engaged, the printer can employ its optical sensors to determine the positions of the edges of the paper, and then begin printing on the first side of the sheet, as the rollers feed the sheet back out of the feeding mechanism over the retracted stops (step 112).

Once the first side has been fully printed, the rollers are disengaged (step 114), the sheet is removed and reversed (step 116), and the stops are deployed (step 118). Some or all of these operations can occur simultaneously, in unison, or independently. For example, the sheet may be removed from the printer after the rollers are disengaged, which takes place simultaneously with the deployment of the stops.

The operator initiates printing of the second side by inserting the printable sheet into the feed mechanism and butting the ends of the registration openings up against the ends of the registration stops to align the sheet in the feed path (step 120). The feed mechanism again engages the rollers (step 122) and retracts the stops (step 124) either simultaneously, in unison, or independently. With the rollers engaged, the printer can begin printing of the second side of the sheet (step 126). The process can then be repeated for further sheets.

Figure 7A:
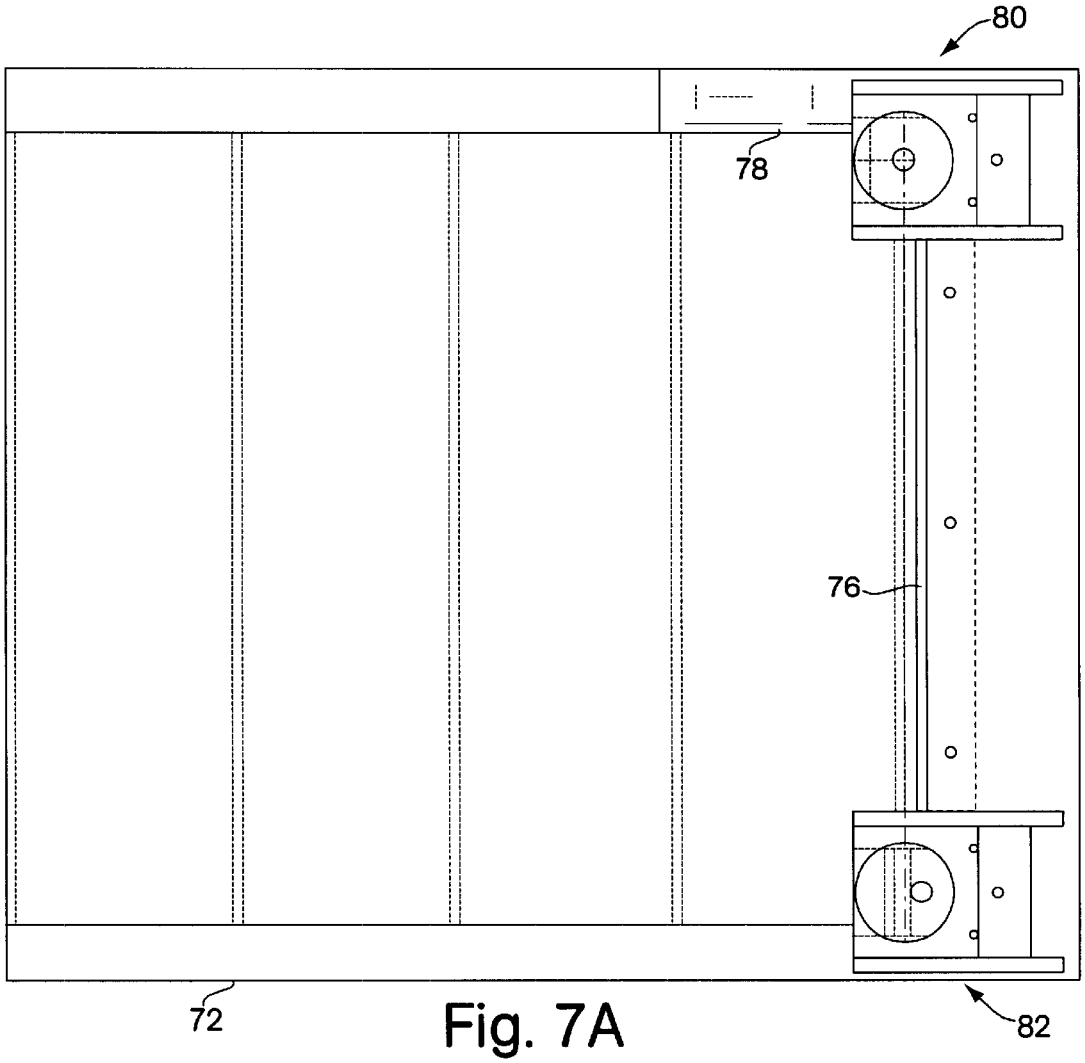
FIG. 7A is a plan view of a punch suitable for making the printable sheet of FIG. 1A.
Figure 7B:
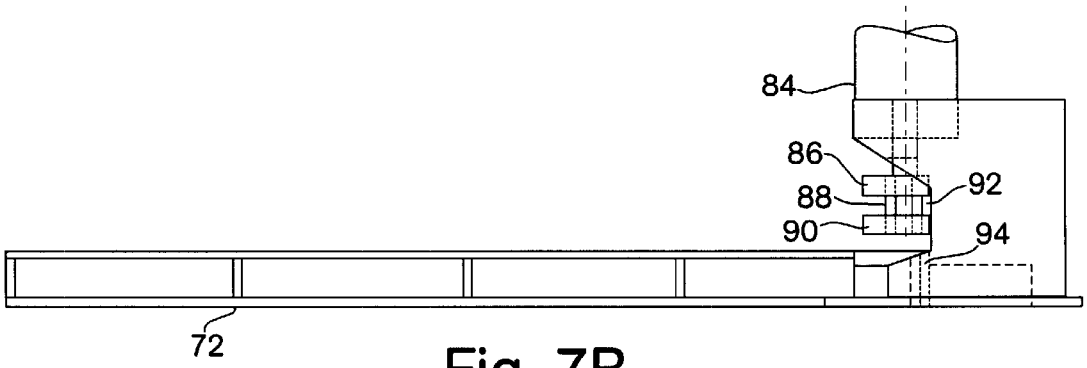
FIG. 7B is an edge view of a punch suitable for making the printable sheet of FIG. 1A.

Referring to FIGS. 7A and 7B, suitable paper can be made using a punch 70. The punch includes a platen 72, a rear stop 76, an end stop 78, and a pair of punch towers 80, 82. The punch towers each include an actuator 84, such as a pneumatic cylinder, solenoid, lever, or motor and reduction gearing. Mounted on an output shaft of each actuator are a collar 86, a spring 88, a stripper plate 90, and a punch 92. Below and in alignment with the punch on each tower is a die opening 94 in the platen. The shape of the die openings and the shape of the punches both match the shape of the registration openings in the printable sheet, and the position of the die openings and the position of the punches with respect to the rear stop and the end stop match the position of the registration openings with respect to the registration edge of the printable sheet and one of the edges adjacent the registration edge.

Sheets are punched by first butting the desired registration edge of a stack of uncut sheets against the rear stop and an adjacent edge against the end stop, and then operating the actuator. This causes the stripper plate to first engage the top of the stack and hold the paper. The spring then begins to compress, allowing the punch, which is attached to the collar, to move downward and slide at least partially into the die openings and thereby cut the registration openings in the stack of sheets. In one embodiment, preferably no more than ten sheets should be cut at one time, to achieve precisely defined registration openings.

The present invention has now been described in connection with a number of specific embodiments thereof. However, numerous modifications which are contemplated as falling within the scope of the present invention should now be apparent to those skilled in the art. Therefore, it is intended that the scope of the present invention be limited only by the scope of the claims appended hereto. In addition, the order of presentation of the claims should not be construed to limit the scope of any particular term in the claims.

What is claimed is:

1. A method of making a deposited ink drop imposition printing sheet, comprising:

providing a rectangular imposition proofing sheet including a first printable face having periphery defined by an ordered series of first, second, third, and fourth edges of the imposition proofing print sheet, and a second rectangular deposited ink drop printable face opposite the first face and also having a periphery being defined by the first, second, third, and fourth edges of the imposition proofing print sheet, and cutting registration means for receiving a pair of rectangular spaced-apart stops along the first edge of the imposition proofing sheet, wherein the registration means define a first registration opening nominally at least 0.5 inches wide and at least 0.25 inches deep, and a second registration opening nominally 0.25 inches wide and at least 0.25 inches deep, and wherein an inner edge of the first registration opening is nominally separated from an inner edge of the second registration opening by at least 38.5 inches.

2. The method of claim 1 wherein the step of cutting is applied to a maximum of ten sheets.

3. The method of claim 1 wherein the sheet exhibits a coefficient of expansion with humidity and wherein the width of the second registation opening exceeds the width of the first registration opening by about a difference between minimum and maximum distances between the first and second registration openings caused by humidity in a direction parallel to the first edge of the imposition proofing sheet.

4. The method of claim 1 wherein the step of cutting defines a pair of rectangular registration opening.

5. The method of claim 4 wherein the step of cutting defines the first registration and second registration openings as openings that begin at the first sheet edge, and wherein the step of cutting defines the first registration and second registration openings such that an inner edge of the firs registration opening is nominally separated from an inner edge of the second registration opening by at least 36 inches.

6. The method of claim 1 wherein the step of cutting defines the first registration and second registration openings as openings that begin at the first sheet edge.

7. The method of claim 1 wherein the step of cutting defines the first registration and second registration openings such that an inner edge of the first registration opening is nominally separated from an inner edge of the second registration opening by at least 36 inches.

8. A deposited ink drop imposition proofing print sheet comprising:

a first rectangular deposited ink drop printable face having a periphery defined by an ordered series of first, second, third, and fourth edges of the imposition proofing print sheet, the first face having properties resulting from a deposited ink drop print-enhancing treatment, a second rectangular deposited ink drop printable face opposite the first face and also having a periphery being defined by the first, second, third, and fourth edges of the imposition proofing print sheet, the second face having properties resulting from a deposited ink drop print-enhancing treatment, wherein the sheet defines a first registration opening, the first registration opening being located closer to the first sheet edge than to the third sheet edge and closer to the second sheet edge than to the fourth sheet edge, wherein the first registration opening is nominally at least 0.5 inches wide and at least 0.25 inches deep, and wherein the sheet defines a second registration opening, the second registration opening being located closer to the first sheet edge than to the third sheet edge and closer to the fourth sheet edge than to the second sheet edge, wherein the second registration opening is nominally 0.25 inches wide and at least 0.25 inches deep, and wherein an inner edge of the first registration opening is nominally separated from an inner edge of the second registration opening by at least 38.5 inches.

9. The deposited ink drop imposition proofing print sheet of claim 8 wherein the sheet exhibits a coefficient of expansion with humidity and wherein the width of the second registration opening exceeds the width of the first registration opening by about a difference between minimum and maximum distances between the first and second registration openings caused by humidity in a direction parallel to the first edge of the imposition proofing sheet.

10. The deposited ink drop imposition proofing sheet of claim 8 wherein the sheet defines the first registration and second registration openings as openings that begin at the first sheet edge.

11. The deposited ink drop imposition proofing print sheet of claim 8 wherein the first and second registration openings are rectangular.

12. The deposited ink drop imposition proofing print sheet of claim 11 wherein the sheet defines the first registration and second registration openings as openings that begin at the first sheet edge.

13. The deposited ink drop imposition proofing print sheet of claim 12 wherein the first and third edges are at least 42 inches in length, and wherein the second and third edges are at least 30 inches in length and wherein the first and second registration openings are peripheral to a 42 inch×30 inch printable area of the sheet.

14. The deposited ink drop imposition proofing print sheet of claim 13 wherein the sheet exhibits a coefficient of expansion with humidity and wherein the width of the second registration opening exceeds the width of the first registration opening by about a difference between minimum and maximum distances between the first and second registration openings caused by humidity in a direction parallel to the first edge of the imposition proofing sheet.

15. The deposited ink drop imposition proofing print sheet of claim 8 wherein the first and second faces are coated with a deposited ink drop print-enhancing composition to achieve the properties.

16. The deposited ink drop imposition proofing print sheet of claim 8 wherein the first and second faces include an added deposited ink drop print-enhancing composition to achieve the properties of the first and second faces.

17. The deposited ink drop imposition proofing print sheet of claim 16 wherein the first and third edges are at least 42 inches in length, and wherein the second and third edges are at least 30 inches in length and wherein the first and second registration openings are peripheral to a 42 inch×30 inch printable area of the sheet.

18. The deposited ink drop imposition proofing print sheet of claim 17 wherein the sheet exhibits a coefficient of expansion with humidity and wherein the width of the second registration opening exceeds the width of the first registration opening by about a difference between minimum and maximum distances between the first and second registration openings caused by humidity in a direction parallel to the first edge of the imposition proofing sheet.

19. The deposited ink drop imposition proofing print sheet of claim 16 wherein the sheet exhibits a coefficient of expansion with humidity and wherein the width of the second registration opening exceeds the width of the first registration opening by about a difference between minimum and maximum distances between the first and second registration openings caused by humidity in a direction parallel to the first edge of the imposition proofing sheet.

20. The deposited ink drop imposition proofing print sheet of claim 16 wherein the sheet defines the first registration and second registration openings as openings that begin at the first sheet edge.

21. The deposited ink drop imposition proofing print sheet of claim 16 wherein the first and second registration openings are rectangular.

22. The deposited ink drop imposition proofing print sheet of claim 21 wherein the first and third edges are at least 42 inches in length, wherein the second and third edges are at least 30 inches in length, wherein the first and second registration openings are peripheral to a 42 inch×30 inch printable area of the sheet, and wherein the sheet defines the first registration and second registration openings as openings that begin at the first sheet edge.

23. The deposited ink drop imposition proofing print sheet of claim 16 wherein the first and second faces include a coating of the deposited ink drop print-enhancing composition.

24. The deposited ink drop imposition proofing print sheet of claim 8 wherein all of the inner edges of the first opening are separated by at least 38.5 inches from all of the inner edges of the second opening.

25. The deposited ink drop imposition proofing print sheet of claim 8 wherein the first and third edges are at least 42 inches in length, and wherein the second and third edges are at least 30 inches in length and wherein the first and second registration openings are peripheral to a 42 inch×30 printable area of the sheet.

26. A deposited ink drop imposition proofing print sheet comprising:

a first rectangular deposited ink drop printable face having a periphery defined by an ordered series of first, second, third, and fourth edges of the imposition proofing print sheet, the first face having properties resulting from a deposited ink drop print-enhancing treatment, a second rectangular deposited ink drop printable face opposite the first face and also having a periphery being defined by the first, second, third, and fourth edges of the imposition proofing print sheet, the second face having properties resulting from a deposited ink drop print-enhancing treatment, wherein the sheet defines a first registration opening, the first registration opening being located closer to the first sheet edge than to the third sheet edge and closer to the second sheet edge than to the fourth sheet edge, and wherein the sheet defines a second registration opening, the second registration opening being located closer to the first sheet edge than to the third sheet edge and closer to the fours sheet edge than to the second sheet edge, wherein the sheet exhibits a coefficient of expansion with humidity and wherein the width of the second registration opening exceeds the width of the first registration opening by about a difference between minimum and maximum distances between the first and second registration openings caused by humidity in a direction parallel to the first edge of the imposition proofing sheet.

27. The deposited ink drop imposition proofing print sheet of claim 26 wherein the sheet defines the first registration and second registration openings as openings that begin at the first sheet edge.

28. The deposited ink drop imposition proofing print sheet of claim 26 wherein the first and third edges are at least 42 inches in length, and wherein the second and third edges are at least 30 inches in length and wherein the first and second registration openings are peripheral to a 42 inch×30 portable area of the sheet.

29. The deposited ink drop imposition proofing print sheet of claim 26 wherein an inner edge of the first registration opening is nominally separated from an inner edge of the second registration opening by at least 36 inches.

30. The deposited ink drop imposition proofing print sheet of claim 29 wherein the first and second registration openings are rectangular.

31. The deposited ink drop imposition proofing print sheet of claim 30 wherein the sheet defines the first registration and second registration openings as openings that begin at the first sheet edge, wherein the first and third edges are at least 42 inches in length, wherein the second and third edges arc at least 30 inches in length, and wherein the first and second registration openings are peripheral to a 42 inch×30 printable area of the sheet.

32. The deposited ink drop imposition proofing print sheet of claim 29 wherein the sheet defines the first registration and second registration openings as openings that begin at the first sheet edge.

33. The deposited ink drop imposition proofing print sheet of claim 26 wherein the first and second registration openings are rectangular.

34. The deposited ii drop imposition proofing print sheet of claim 33 wherein the sheet defines the first registration and second registration openings as openings that begin at the first sheet edge.

35. The deposited ink drop imposition proofing print sheet of claim 26 wherein the first and second faces include an added deposited ink drop print-enhancing composition to achieve the properties of the first and second faces.

36. The deposited ink drop imposition proofing print sheet of claim 35 wherein an inner edge of the first registration opening is nominally separated from an inner edge of the second registration opening by at least 36 inches.

37. The deposited ink drop imposition proofing print sheet of claim 35 wherein the first and second registration openings are rectangular.

38. The deposited ink drop imposition proofing print sheet of claim 35 wherein the sheet defines the first registration and second registration openings as openings that begin at the fist sheet edge.

39. The deposited ink drop imposition proofing print sheet of claim 38 wherein au inner edge of the first registration opening is nominally separated from an inner edge of the second registration opening by at least 36 inches, wherein the first and second registration openings are recangular, wherein the first and third edges are at least 42 inches in length, wherein the second and third edges are at least 30 inches in length and wherein the first and second registration openings are peripheral to a 42 inch×30 inch printable area of the sheet.

40. A method of making a deposited ink drop imposition printing sheet, comprising:

providing a rectangular imposition proofing sheet including a first printable face having periphery defined by an ordered series of fist, second, third, and fourth edges of the imposition proofing print sheet, and a second rectangular deposited ink drop printable face opposite the first face and also having a periphery being defined by the first second, third, and fourth edges of the imposition proofing print sheet, and cutting first and second registration openings for receiving a pair of rectangular spaced-apart stops along the first edge of the imposition proofing sheet, wherein the sheet exhibits a coefficient of expansion with humidity and wherein the width of the second registration opening exceeds the width of the first registration opening by about a difference between minimum and maximum distances between the first and second registration openings caused by humidity in a direction parallel to the first edge of the imposition proofing sheet.

41. The method of claim 40 wherein the step of cutting defines a pair of rectangular registration openings.

42. The method of claim 40 wherein the step of cutting defines the first registration and second registration openings as openings that begin at the first sheet edge.

43. The method of claim 42 wherein the step of cutting defines a pair of rectangular registration openings.

44. The method of claim 40 wherein the step of cutting is applied to a maximum of ten sheets.

* * * * *

UNITED STATES PATENT AND TRADEMARK OFFICE

CERTIFICATE OF CORRECTION

PATENT NO. : 6,314,885 B1 
DATED : November 13, 2001
INVENTOR(S) : Tobin et al.

It is certified that error appears in the above-identified patent and that said Letters Patent is hereby corrected as shown below:

Column 7,
Line 38, where “registation” should read -- registration --;
Line 45, where “opening” should read -- openings --;

Column 8,
Line 29, after “proofing” insert -- print --;

Column 9,
Line 44, after “30” insert -- inch --;
Line 66, where “fours” should read -- fourth --;

Column 10,
Line 15, where “30 portable” should read -- 30 inch printable --;
Line 29, where “arc” should read -- are --;
Line 30, after “30” insert -- inch --;
Line 39, where “ii” should read -- ink --;
Line 57, where “fist” should read -- first --;
Line 59, where “au inner edge” should read -- an inner edge --;

Column 11,
Line 9, where “first second, third,” should read -- first, second, third, --.

Signed and Sealed this

Twenty-eighth Day of October, 2003

JAMES E. ROGAN
*Director of the United States Patent and Trademark Office*